US006481812B1

(12) United States Patent
Domenig et al.

(10) Patent No.: US 6,481,812 B1
(45) Date of Patent: Nov. 19, 2002

(54) UNDERMOUNT DRAWER GUIDE ASSEMBLY

(75) Inventors: Georg Domenig, Kernersville, NC (US); Andreas Moser, Kernersville, NC (US); Joseph B. Larsen, Jr., Kernersville, NC (US)

(73) Assignee: Grass America, Inc., Kernersville, NC (US)

( * ) Notice: Subject to any disclaimer, the term of this patent is extended or adjusted under 35 U.S.C. 154(b) by 57 days.

(21) Appl. No.: 09/664,106

(22) Filed: Sep. 19, 2000

(51) Int. Cl.[7] ..... A47B 88/04

(52) U.S. Cl. ..... 312/334.6; 312/334.27; 312/334.45

(58) Field of Search ..... 312/334.6, 334.27, 312/334.31, 334.32, 334.33, 334.36, 334.37, 334.39, 334.44, 334.45; 384/19, 21

(56) References Cited

U.S. PATENT DOCUMENTS

| | | | | |
|---|---|---|---|---|
| 1,089,514 A | 3/1914 | Wagemaker | ..... | 312/334.13 |
| 1,951,390 A | 3/1934 | Barker | | |
| 2,142,897 A | 1/1939 | Harmon | | |
| 2,200,319 A | 5/1940 | Zalkind | | |
| 2,361,116 A | 10/1944 | Mayer | | |
| 2,418,244 A | 4/1947 | Baird | | |
| 2,484,377 A | 10/1949 | Eramo et al. | | |
| 2,575,566 A | 11/1951 | Shand | | |
| 3,053,582 A | 9/1962 | Wenger | | |
| 3,482,888 A | 12/1969 | Anderson | | |

(List continued on next page.)

FOREIGN PATENT DOCUMENTS

| | | | | |
|---|---|---|---|---|
| CA | 0463561 | 3/1950 | ..... | 312/334.15 |
| CA | 622570 * | 6/1961 | ..... | 312/334.45 |
| CH | 195282 | 1/1938 | | |
| DE | 2946113 A1 | 5/1981 | | |
| DE | 3942518 A1 | 5/1990 | | |
| EP | 0780071 A2 | 6/1997 | | |
| GB | 608384 | 9/1948 | | |
| NL | 43444 | 6/1938 | | |
| WO | WO 97/18732 A1 | 5/1997 | | |

OTHER PUBLICATIONS

Mepla, Inc., "Motion by MEPLA: Dynamic Drawer Slides," product description, 4 pages, undated, in existence as of Sep. 18, 2000.

*Primary Examiner*—James O. Hansen
(74) *Attorney, Agent, or Firm*—John M. Harrington; Kilpatrick Stockton LLP

(57) ABSTRACT

A drawer guide assembly for a movable structure such as a drawer in a furniture article, and more particularly to a new and improved drawer guide assembly which is concealed from view and allows for a wider and deeper drawer. The drawer guide assembly contains mirror image assemblies, each comprising a guide rail mountable to the interior of a furniture article in a generally horizontally disposed position and a pull-out rail mountable to the drawer, or other movable structure, and movable within the guide rail. Both the guide and pull-out rails are provided with one or more rotatable rollers mounted in fixed positions and upper and/or lower ledges which are in rolling contact with complementary rotatable rollers, thus enabling forward and rearward horizontal movement of the pull-out rail and carried structure on the fixed guide rail.

32 Claims, 5 Drawing Sheets

U.S. PATENT DOCUMENTS

| | | | | |
|---|---|---|---|---|
| 3,716,284 | A | 2/1973 | Vogt | |
| 3,926,491 | A | 12/1975 | Greer | 312/330.1 |
| 4,037,897 | A | 7/1977 | Siggia | |
| 4,557,531 | A | 12/1985 | Röck et al. | |
| 4,558,908 | A | 12/1985 | Röck et al. | |
| 4,564,248 | A | 1/1986 | Grass | |
| 4,606,588 | A | 8/1986 | Koch | |
| 4,659,237 | A | 4/1987 | Rapp | 384/19 |
| 4,728,200 | A | 3/1988 | Röck et al. | 384/19 |
| 4,955,160 | A | 9/1990 | Röck | |
| 4,995,683 | A | 2/1991 | Albiez | 312/348.4 |
| 5,020,868 | A | 6/1991 | Brunnert | 312/319 |
| 5,275,483 | A | 1/1994 | Rasmussen | 312/334.41 |
| 5,433,517 | A | 7/1995 | Fleisch | 312/334.8 |
| 5,490,724 | A | 2/1996 | Domenig | 312/334.45 |
| 5,536,083 | A | 7/1996 | Brüstle et al. | 312/334.6 |
| 5,641,216 | A | 6/1997 | Grass | 312/334.27 |
| 5,664,855 | A | 9/1997 | Lautenschläger et al. | 312/334.4 |
| 5,709,443 | A | 1/1998 | Lauitenschläger | 312/334.14 |
| 5,775,787 | A | 7/1998 | Gasser | 312/334.12 |
| 5,893,619 | A | 4/1999 | Nachbaur | 312/334.44 |
| 5,895,102 | A | 4/1999 | Fleisch | 312/334.6 |
| 6,027,193 | A | 2/2000 | Domenig et al. | 312/334.14 |
| 6,142,596 | A | 11/2000 | Carson | 312/334.39 |

* cited by examiner

UNDERMOUNT DRAWER GUIDE ASSEMBLY

FIELD OF THE INVENTION

The present invention relates to a drawer guide assembly for a movable structure such as a drawer in a furniture article, and more particularly to a new and improved drawer guide assembly which is concealed from view and allows for a wider and deeper drawer. The drawer guide assembly contains mirror image assemblies, each comprising a guide rail mountable to the interior of a furniture article in a generally horizontally disposed position and a pull-out rail mountable to the drawer, or other movable structure, and movable within the guide rail. Both the guide and pull-out rails are provided with one or more rotatable rollers mounted in fixed positions and upper and/or lower ledges which are in rolling contact with complementary rotatable rollers, thus enabling forward and rearward horizontal movement of the pull-out rail and carried structure on the fixed guide rail.

BACKGROUND OF THE INVENTION

Various types of drawer guide assemblies are used for drawers housed by articles of furniture, such as desks and cabinets, to enable smooth and efficient extension of the drawers from within the furniture housing. Drawer guides are often used in pairs with each drawer guide assembly comprising two or more parts.

Drawer guide assemblies of the type of the present invention generally have a pull-out rail with a roller at or near the rear end of the rail and a guide rail with a roller at or near the front end of the rail. The pull-out rail roller rolls in a track within the guide rail, and a portion of the pull-out rail serves as a rolling surface for the guide rail roller. Generally, such two-part drawer guides also include a stop means which limits extension of a drawer to about three-fourths of the drawer depth. Such a means for limiting extension is necessary because, as the pull-out rail roller rolls forward and approaches the front end of the guide rail, the front of the drawer tends to sag or cantilever under the weight of the drawer and its contents.

Traditional approaches have addressed the problem of sagging or cantilevering when a drawer is extended by using drawer guide construction combining three parts. For example, a three-part drawer guide may use either an additional rail member disposed between the pull-out rail and the guide rail, or an additional running rail portion which can be extended and/or tilted about an axis. U.S. Pat. No. 4,557,531 to Röck et al. is an example of a three-part pull-out guide assembly which uses a pull-out rail, a support rail, and an intermediate roller carrier. In such constructions, three-part drawer guides are more complicated to manufacture. In order to obtain the desired advantages, such as ease of movement, a high load bearing ability, and a high transverse stability, these devices are constructed of multiple pieces which must be precisely manufactured and assembled at higher cost and labor intensity. Two-part drawer guide assemblies including a pull-out rail fastened to a drawer and a guide rail fastened to the corresponding side a furniture article interior are typically simpler and more cost-efficient to make.

Another disadvantage of conventional drawer guide assemblies is placement of one or more or the parts on the side of a drawer. As an example, each of the three parts in the Röck et al. guide assembly are mounted on the side of a drawer such that when the drawer is extended into open position, the guide assembly is in full view. Placement of guide assemblies on sides of drawers or other moveable structures diminishes the aesthetic appeal of an article of furniture. Fastening a pull-out rail underneath a drawer conceals the drawer guide from view so as to avoid detracting from the appearance of a furniture article. In addition, an undermount drawer guide assembly generally enables the use of a wider drawer within a drawer opening of a given width. U.S. Pat. No. 4,659,237 to Rapp illustrates a concealed guide rail assembly mounted underneath a drawer. While the Rapp patent provides a concealed undermount assembly, it uses a three-part pull-out guide, including a runner carriage between a supporting rail and a pull-out rail. Thus, there is a need for a drawer guide assembly that comprises two parts that can be concealably mounted underneath a drawer such that a drawer can be made as wide and as deep as possible.

Drawer guide assemblies have often exhibited other disadvantages. For example, drawers having pull-out rails easily movable upon guide rail rollers can accidentally open or fall completely out of an article of furniture when the furniture is tipped over or the drawer is pulled open with excessive force. Therefore, a drawer guide assembly using pull-out rails easily movable upon rollers would optimally include a means for preventing accidental opening and unintentionally pulling drawers completely out of a furniture housing.

Another disadvantage of drawer guide assemblies having pull-out rails in rolling contact with fixed guide rails is that forward and rearward horizontal movement of a pull-out rail and drawer may produce undesirable lateral movement of the pull-out rails and drawer. Such undesired lateral movement may cause disengagement of the pull-out rails from the guide rails. To overcome such disadvantages, drawer guide assemblies having pull-out rails in rolling contact with fixed guide rails would provide means for preventing disengagement of pull-out rails and guide rails from complementary rollers when a lateral force is applied to a drawer carried by the pull-out rail.

Thus, there remains a need for a drawer guide assembly that comprises two parts, that is mountable underneath a drawer such that the guide assembly is concealed and the drawer can be made as wide and deep as possible, and that overcomes disadvantages of prior assemblies.

SUMMARY OF THE INVENTION

It is a feature and advantage of the present invention to provide a two-part drawer guide assembly that overcomes the appearance problems and dimensional limitations of side-mounted and three-part guide assemblies. Another advantage of drawer guide assemblies of the present invention is improved cost efficiencies and ease of manufacture.

The general purpose of the present invention is to provide a new and improved drawer guide to be used at each side of a drawer to guide movement of the drawer into and out of a cabinet which provides advantages lacking in existing devices and none of the disadvantages. A drawer guide assembly of the present invention comprises a pull-out rail adapted for carrying a structure such as a drawer, and a guide rail adapted for mounting to the interior of an article of furniture, such as a cabinet, in a generally horizontally disposed position.

The pull-out rail of the present invention can be advantageously mounted on the underside of a drawer directly adjacent the side wall of the drawer and projecting downwardly below the underside of the drawer. Mounting the drawer guide assembly underneath a drawer allows the assembly to be concealed from view, thereby enhancing the appearance of the furniture article when the drawer is opened. Alternatively, if the side walls of the drawer are constituted by hollow profiles of metal or plastic materials or are open at the underside, a pull-out rail of the present invention may be mounted within the side wall of the drawer.

A pull-out rail of the present invention may include: a pull-out rail upper ledge in rolling contact with a guide rail roller so as to enable forward and rearward horizontal movement of the pull-out rail and carried structure; a pull-out rail roller in rolling contact with a guide rail lower ledge; a pull-out rail upper ledge flange in rolling contact with the guide rail roller; a pull-out rail lower ledge extending laterally from the pull-out rail upper ledge flange; an undermount attachment flange along the length of the pull-out rail for attaching the pull-out rail to the carried structure; a pull-out rail retaining member located in the pull-out rail upper ledge near the pull-out rail front end; a forward motion stop member located in the pull-out rail upper ledge near the pull-out rail rear end; and a means for mounting the pull-out rail to the rear end of a drawer or other carried structure.

A guide rail of the present invention, which is adapted for mounting to the housing of a furniture article, may include: a guide rail upper ledge capable of receiving the pull-out rail roller; a guide rail roller in rolling contact with the pull-out rail upper ledge; a guide rail lower ledge; a guide rail retaining member located in the guide rail lower ledge near the guide rail rear end; a rearward motion stop member located in the guide rail upper ledge near the guide rail rear end; a downwardly extending guide rail upper ledge flange and an upwardly extending guide rail lower ledge flange both in rolling contact with the pull-out rail roller; a guide rail front end mounting means; and a guide rail rear end mounting means.

In a preferred embodiment of the present invention, the guide rail roller and the pull-out rail roller are substantially aligned in a horizontal plane. Such side-by-side relationship of the rollers is an advantage over the conventional offset, or top-to-bottom, relationship of rollers. Horizontal alignment of rollers allows for a more shallow space for mounting a pull-out rail underneath a drawer. As a result, carpentry specifications for manufacturing a drawer to accommodate an undermount pull-out rail would not have to be changed from a typical drawer design.

In an embodiment of the present invention, the pull-out rail includes an obliquely disposed retaining member located in the front end area of the pull-out rail upper ledge. The pull-out rail retaining member preferably has a run-in slope that is downward in the direction from the pull-out rail front end toward the pull-out rail rear end. The pull-out rail retaining member engages the guide rail roller when the pull-out rail is in a rearward position so as to resist forward movement of the pull-out rail and prevent undesired opening of a drawer.

An embodiment of the present invention includes a guide rail retaining member in the guide rail lower ledge proximate the guide rail rear end. The guide rail retaining member may be formed with a downward run-in slope toward the guide rail rear end, preferably parallel to the run-in slope of the pull-out rail retaining member. The guide rail retaining member serves as a rolling surface for the pull-out rail roller and improves the pull-in and staying-closed behavior of a drawer, especially in the case of drawers of little net weight and small load capacity. When the pull-out rail is moved inward in the closing direction of a drawer, the pull-out rail roller and guide rail roller simultaneously reach the guide rail retaining member and the pull-out rail retaining member, respectively. The pull-out rail roller rolls into the downwardly sloping guide rail retaining member, and the pull-out rail retaining member engages the guide rail roller, causing the pull-out rail, under the weight of the drawer, to roll downward along the slope of the pull-out rail retaining member to automatically close the drawer.

In order to limit further rearward movement of a pull-out rail and a carried drawer in the rearwardly disposed closed position of the drawer, the guide rail may be provided with a means for stopping further inward movement of the pull-out rail. In an embodiment of the present invention, a means for stopping further inward movement of the pull-out rail comprises a rearward motion stop member located on the guide rail upper ledge. The rearward motion stop member is positioned to prevent further inward movement of the pull-out rail at a predetermined point, for example, the point near the guide rail rear end at which a drawer is fully closed. The rearward motion stop member may be positioned at the most rearward point on the guide rail, which allows the rear end of a drawer to stop as close to the rear wall of the housing of a furniture article as possible, thereby permitting the greatest lengthwise drawer construction possible. A rearward motion stop member may be formed as a V-shaped projection depending downwardly from the guide rail upper ledge and configured to engage the pull-out rail roller.

An embodiment of the present invention may also comprise a pull-out rail forward motion stop means located proximate the rear end of the pull-out rail. The pull-out rail forward motion stop member may be configured to prevent further outward, or forward, movement of the pull-out rail at a predetermined point in which the carried structure is extended from the cabinet as far as it will extend. In a preferred embodiment, the pull-out rail forward motion stop member comprises at least one downwardly depending V-shaped projection formed in the pull-out rail upper ledge and configured to engage the guide rail roller. In a more preferred embodiment, a forward motion stop member comprises two downwardly depending projections formed in the pull-out rail upper ledge. The two downwardly depending projections are spaced apart to provide locking engagement of the guide rail roller between the two projections. The forward motion stop member with two projections thus provides a means for securing a drawer in position so that the drawer can be used to support a non-moving surface, for example, a cutting board.

In an embodiment of the present invention, the pull-out rail upper ledge includes a downwardly depending flange located along the longitudinal axis on the inside of the pull-out rail which engages the guide rail roller. In a preferred embodiment, the pull-out rail upper ledge also includes a downward projection located along the longitudinal axis of the pull-out rail and spaced from the pull-out rail upper ledge flange so as to provide a channel for continuous rolling engagement of the guide rail roller. The guide rail roller is effectively captured between the flange and the downward projection of the pull-out rail upper ledge. Thus, when a lateral force is applied to a drawer or other object carried by the pull-out rail, the pull-out rail upper ledge flange and downward projection prevent the pull-out rail from becoming disengaged from the guide rail roller.

In an embodiment of the present invention, the guide rail includes an upwardly projecting lower ledge flange and a downwardly protruding upper ledge flange. In combination with the pull-out rail upper ledge flange, the guide rail upwardly projecting lower ledge flange and downwardly projecting upper ledge flange significantly reduce side-to-side movement, or "side play," of a drawer. As such, disengagement of a pull-out rail from a guide rail is prevented.

An embodiment of the present invention also comprises a pull-out rail lower ledge extending laterally from the downwardly depending flange of the pull-out rail upper ledge toward the pull-out rail roller. The pull-out rail lower ledge is located in substantial vertical alignment with the guide rail upper ledge flange and lower ledge flange. Such configuration of the guide rail upper ledge flange, guide rail lower ledge flange, and guide rail roller with the pull-out rail upper ledge flange, pull-out rail lower ledge, and pull-out rail roller prevents disengagement during movement of the pull-out rail along the guide rail. Additionally, the pull-out rail lower ledge, which rides underneath the guide rail upper ledge flange, and above the guide rail lower ledge flange, prevents the drawer or carried object from contacting the cabinet frame in the event that the cabinet is in other than its normally upright position, for example, during shipment.

A pull-out rail of the present invention may be mounted to a drawer or other carried object by use of a mounting means adapted for mounting the pull-out rail to the bottom of a side wall of a drawer and to the rear end wall of a drawer. Preferably, a pull-out rail comprises an undermount attachment flange extending laterally from the pull-out rail and having holes suitable for fasteners such as screws or nails. By fastening the undermount attachment flange to the bottom of a side wall of a drawer, the pull-out rail can be mounted in position for proper operation with a guide rail. A pull-out rail may be further fastened to a drawer by attaching a rear end mounting bracket to the pull-out rail and to the rear end wall of a drawer. In an embodiment, a pull-out rail rear end mounting bracket has an "L" shape with a horizontal shank and a vertical shank and is fixedly attached to the upper ledge and near the rear end of the pull-out rail.

A guide rail of the present invention may be mounted to the inside wall of an article of furniture or cabinet by use of mounting means for at least the guide rail front end and the guide rail rear end. A guide rail front end mounting bracket is preferably located on the outer side of the guide rail roller towards the cabinet wall. A guide rail rear end mounting bracket is preferably located at the end point of the guide rail and configured so as to permit mounting of the guide rail to the end wall of the cabinet and lateral adjustment of the guide rail subsequent to mounting. The guide rail rear end mounting bracket comprises a channel for adjustably receiving the guide rail rear end. In an embodiment, the guide rail rear end mounting bracket channel is a V-shaped notch. In embodiments, means for mounting a guide rail to a furniture article includes an intermediate guide rail mounting bracket and one of the guide rail front end mounting bracket and the guide rail rear end mounting bracket.

In another embodiment of the present invention, the pull-out rail lower ledge may include an extension which may be used for mounting to the front wall of a drawer. The pull-out rail lower ledge extension provides both additional strength for the pull-out rail which prevents bowing of the rail, and a means for easy alignment of the pull-out rail on the drawer or carried object during assembly.

A guide rail lower ledge of the present invention may also include an upwardly projecting flange. The guide rail lower ledge flange provides further strength to the guide rail to prevent disfigurement of the guide rail (for example, bowing). The guide rail lower ledge flange, in conjunction with the downwardly depending flange on the guide rail upper ledge, provides a capture of the pull-out rail roller and prevents disengagement (caused by excessive lateral movement, for example) of the pull-out rail from the guide rail.

The present invention has a variety of features and advantages. importantly, embodiments of the present invention address and overcome complications and disadvantages associated with conventional drawer guide assemblies. For example, rather than decreasing available space for drawer capacity by mounting guide rails on sides of drawers, a drawer guide assembly of the present invention mounted underneath a drawer provides the advantage of using the widest possible drawer within a drawer opening of a given width. Another advantage is that mounting a drawer guide assembly underneath a drawer allows the assembly to be concealed from view and enhance the appearance of a furniture article when the drawer is opened.

Another advantage of the present invention is that the guide rail roller and the pull-out rail roller are substantially aligned in a horizontal plane, which allows for a more shallow space for mounting a pull-out rail underneath a drawer. As a result, an undermount drawer guide assembly of the present invention can be used with a conventional drawer design. In addition, by requiring less space for a pull-out rail underneath a drawer, the present invention allows use of a deeper drawer than would typically be allowed with a conventional undermount guide.

Another advantage is that drawer guide assemblies of the present invention provide rearward motion stop means positioned at the most rearward point on a guide rail, which allows the rear end of a drawer to stop as close to the rear wall of a furniture article as possible, allowing use of a longer (front-to-back) drawer construction.

The present invention advantageously provides a simpler and more cost-effective drawer guide assembly, using two parts to prevent sagging and cantilevering when a drawer is extended to an open position. Use of a partial-extension drawer guide assembly provides the additional advantage of lower cost manufacture than full-extension drawer guides.

The present invention provides the advantage of a drawer guide assembly using forward motion stop means located near the rear end of the pull-out rail and configured to prevent further outward movement of the pull-out rail when a drawer is extended from a cabinet.

Another advantage is that a drawer guide assembly using pull-out rails easily movable upon rollers as in the present invention includes a means for preventing accidental opening and unintentionally pulling drawers completely out of a furniture housing.

Yet another advantage of the present invention is that drawer guide assemblies having pull-out rails in rolling contact with fixed guide rails are provided with means for preventing disengagement of pull-out rails and guide rails from complementary rollers when a lateral force is applied to a drawer.

The present invention provides the further advantage of various guide rail attachment options in a two-part, undermount drawer guide assembly.

The present invention is intended for use in pairs, that is, a right-hand drawer guide to support the right side of a drawer and a left-hand drawer guide to support the left side of the drawer. A left-hand drawer guide is a mirror image of a right-hand drawer guide. While a right-hand guide rail is illustrated in the drawings, the specification and claims relate equally to both left-hand and right-hand drawer guide assemblies.

There has been outlined rather broadly the more important features of the invention in order that the detailed description thereof that follows may be better understood and in order that the present contribution to the art may be better appreciated. In addition to aspects described above, other features of the invention will be described hereinafter and will form the subject matter of the claims appended hereto. In this respect, it is to be understood that the invention is not limited in its application to the details of construction and to the arrangement of the components set forth in the following description or illustrated in the drawings.

The invention is capable of other embodiments and of being practiced and carried out in various ways. It is to be further understood that the phraseology and terminology employed herein are for the purpose of description and should not be regarded as limiting. As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The invention will be better understood and advantages other than those set forth above will become apparent when consideration is given to the following detailed description. Such description makes reference to the annexed drawings wherein.

DETAILED DESCRIPTION

Figure 1:
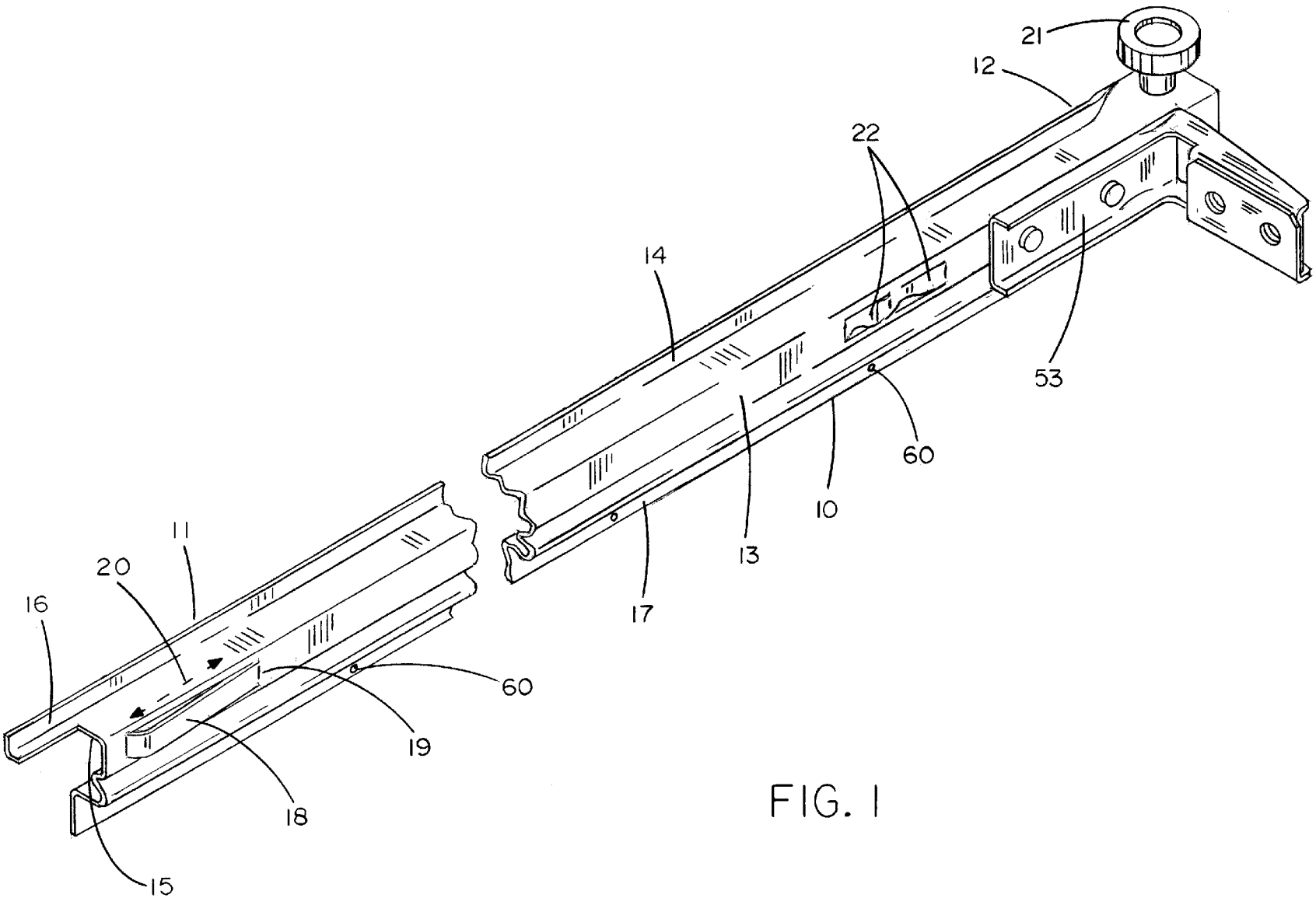
FIG. 1 is a top/side perspective view of a pull-out rail of the present invention for use on the right side (determined by looking at the front) of a drawer or carried object.
Figure 2:
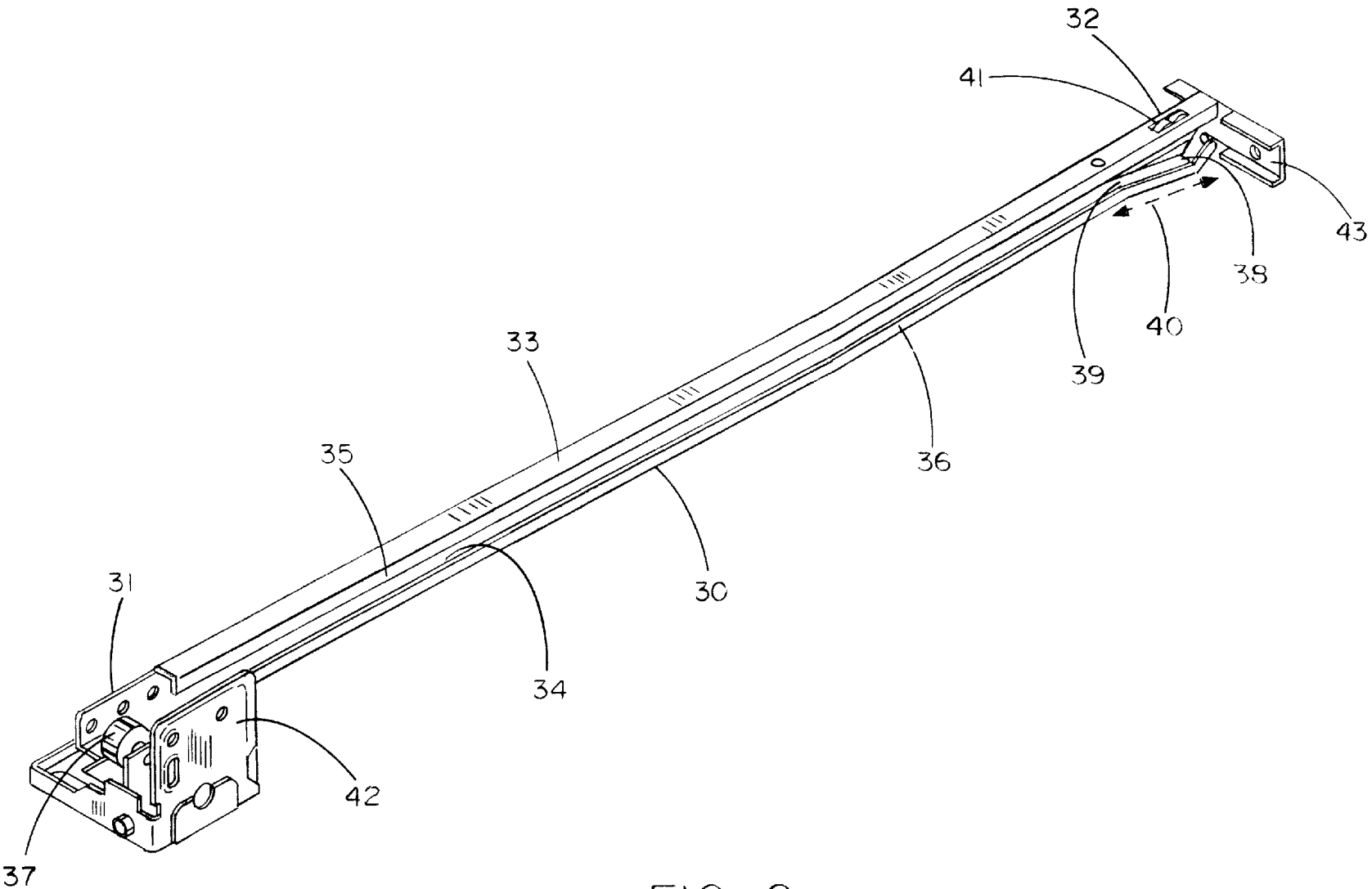
FIG. 2 is a top/side perspective view of a guide rail of the present invention for use on the right side (determined by looking at the front) of a drawer or carried object.
Figure 4:
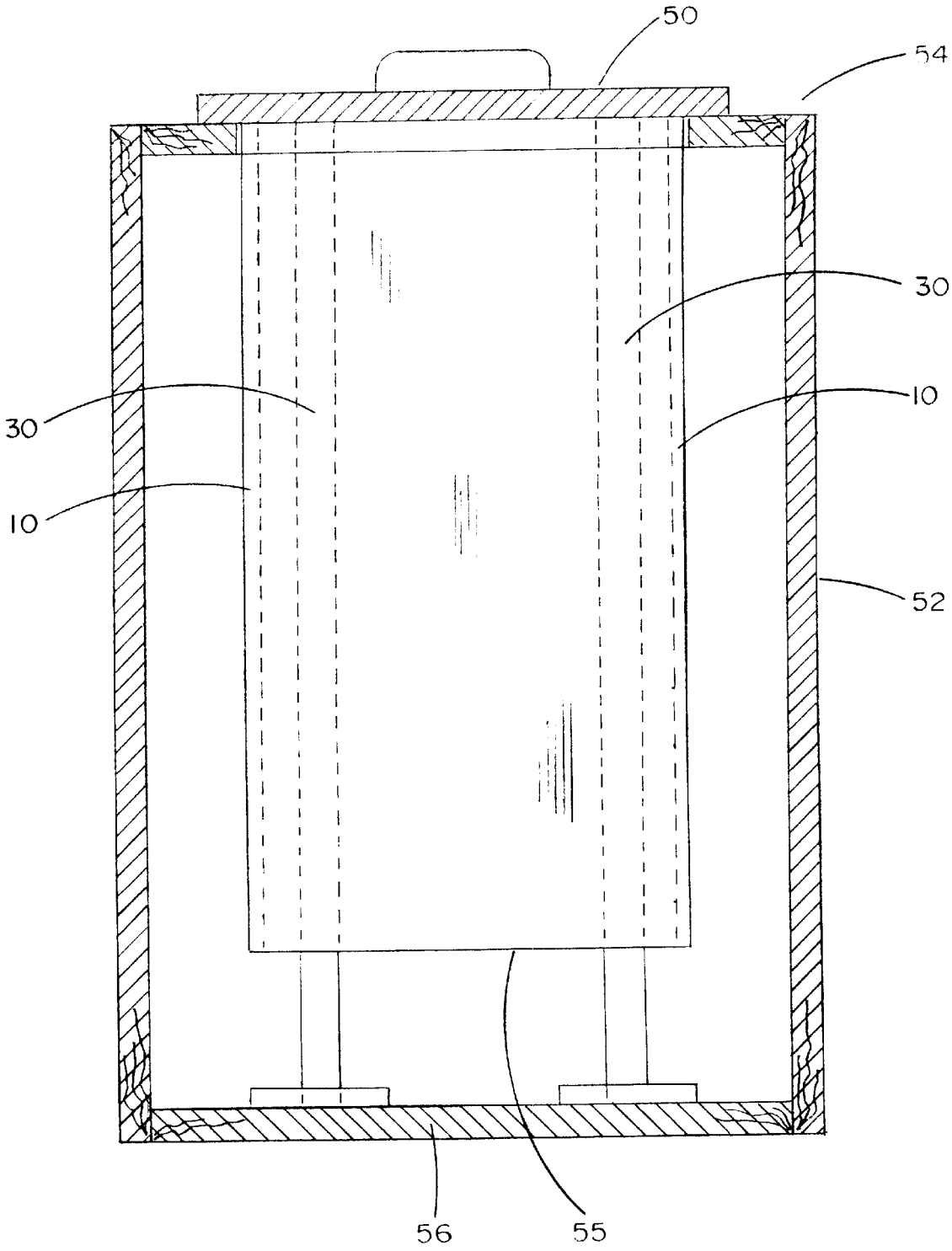
FIG. 4 is a top cross-section view of a drawer inside a furniture housing, showing the relative positions of a pull-out rail and a guide rail of the present invention when assembled together.

Referring now to the drawings and specifically to FIGS. 1 and 4, an embodiment of a drawer guide assembly of the present invention includes a pull-out rail 10 having a front end 11 and a rear end 12, and a longitudinal axis therebetween. Front end 11 is to be aligned with front end 54 of a drawer 50 and rear end 12 is to be aligned with rear end 55 of drawer 50. Referring to FIGS. 2 and 4, an embodiment of a guide rail 30 of the present invention includes a front end 31 to be aligned with front end 54 of a furniture cabinet housing 52 and a rear end 32 to be aligned with rear wall 56 of furniture cabinet housing 52. As can be seen in FIG. 4, guide rail 30 is mounted to the furniture cabinet housing 52 in a horizontally disposed position and pull-out rail 10 is mounted to the bottom of drawer 50 in substantially close horizontal alignment with guide rail 30. Such alignment of guide rail 30 and pull-out rail 10 allows rolling contact between various aspects of each rail to facilitate forward and rearward movement of drawer 50 relative to furniture cabinet housing 52.

Figure 3:
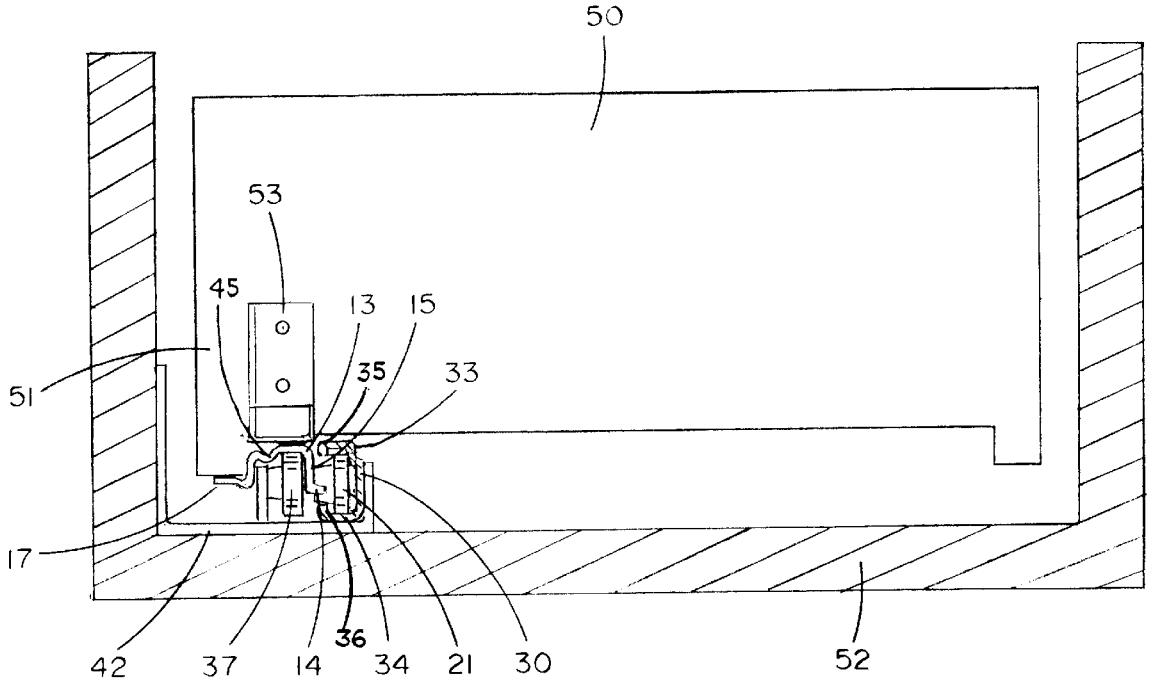
FIG. 3 is a rear view of the pull-out rail of FIG. 1 and the guide rail of FIG. 2 assembled together and mounted underneath a drawer inside an article of furniture, showing the drawer guide assembly in partial cross-section.

As can be seen in FIGS. 3 and 4, mounting pull-out rail 10 underneath drawer 50 allows the guide rail assembly to be concealed from view, and thus enhance the appearance of the furniture article (cabinet 52) when drawer 50 is opened.

Referring to FIGS. 1 and 2, guide rail 30 comprises an upper ledge 33 and a lower edge 34. A guide rail roller 37 is disposed proximate guide rail front end 31 and rotatably mounted to guide rail 30. Pull-out rail 10 comprises a pull-out rail upper ledge 13, the bottom side of which is in rolling contact with guide rail roller 37, enabling movement of pull-out rail 10 and a carried structure (drawer 50) between forward and rearward positions relative to guide rail 30. A pull-out rail roller 21 is in rolling contact with guide rail lower ledge 34. In addition, pull-out rail roller 21 is coupled to pull-out rail 10 so as to be in rolling contact with guide rail upper ledge 33. Guide rail upper ledge 33 is sufficiently close to pull-out rail roller 21 so as to prevent excessive upward movement of pull-out rail roller 21. Pull-out rail upper ledge 13 further comprises a pull-out rail upper ledge flange 15 forming an inner side of a channel in upper ledge 13 for receiving guide rail roller 37.

In a preferred embodiment of the present invention, guide rail roller 37 and pull-out rail roller 21 are substantially aligned in a horizontal plane (FIG. 3). Such side-by-side relationship of the rollers 37, 21 allows for a more shallow space for mounting pull-out rail 10 underneath drawer 50. As a result, carpentry specifications for manufacturing a drawer to accommodate undermount pull-out rail 10 would not have to be changed from a typical drawer design.

In an embodiment of the present invention, pull-out rail upper ledge 13 includes a downwardly depending flange 15 located along the longitudinal axis on the inside of pull-out rail 10 which engages guide rail roller 37. In a preferred embodiment, pull-out rail upper ledge 13 also includes downward projection 45 located along the longitudinal axis of pull-out rail 10 and spaced from pull-out rail upper ledge flange 15 so as to provide a channel for continuous rolling engagement of guide rail roller 37. Guide rail roller 37 is effectively captured between flange 15 and downward projection 45 of pull-out rail upper ledge 13. Thus, when a lateral force is applied to drawer 50 or other object carried by pull-out rail 10, pull-out rail upper ledge flange 15 and downward projection 45 prevent pull-out rail 10 from becoming disengaged from guide rail roller 37.

In an embodiment of the present invention, pull-out rail upper ledge 13 includes a bend 19 positioned proximate front end 11 of pull-out rail 10, and has a pull-out rail retaining member 18 extending obliquely from bend 19 relative to the longitudinal axis of pull-out rail 10 in an upwardly inclined direction toward pull-out rail front end 11. Pull-out rail retaining member 18 preferably has a run-in slope 20 for engaging guide rail roller 37 in a rearward position of pull-out rail 10 relative to guide rail 30 so as to resist forward movement of pull-out rail 10.

In an embodiment of the present invention, guide rail lower ledge 34 includes a bend 39 positioned proximate rear end 32 of guide rail 30, and has a guide rail retaining member 38 extending obliquely from bend 39 relative to guide rail 30 in an downwardly inclined direction toward guide rail rear end 32. Guide rail retaining member 38 preferably has a run-in slope 40 substantially parallel to run-in slope 20 of pull-out rail retaining member 18 for engaging pull-out rail roller 21.

Pull-out rail roller 21 is disposed proximate rear end 12 of pull-out rail 10 so that when pull-out rail 10 is in a rearward position relative to guide rail 30, guide rail retaining member 38 engages pull-out roller 21. When pull-out rail 10 is moved inward in the closing direction of drawer 50, pull-out rail roller 21 and guide rail roller 37 simultaneously reach the guide rail retaining member 38 and the pull-out rail retaining member 18, respectively. Pull-out rail roller 21 rolls into the downwardly sloping guide rail retaining member 38, and pull-out rail retaining member 18 engages guide rail roller 37, causing pull-out rail 10, under the weight of drawer 50, to roll downward along the slope of pull-out rail retaining member 18 to automatically close the drawer.

Guide rail upper ledge 33 comprises a downwardly protruding guide rail upper ledge flange 35 for continuous rolling engagement of pull-out rail roller 21. Alignment of pull-out upper ledge 13 with guide rail roller 37 and guide rail 30 with pull-out rail roller 21 may best be seen in FIG. 3. Guide rail lower ledge 34 further comprises an upwardly protruding guide rail lower ledge flange 36 for continuous rolling engagement of pull-out rail roller 21. Guide rail upper ledge flange 35, in cooperation with guide rail lower ledge flange 36 and guide rail roller 37, prevent disengagement of pull-out rail 10 from guide rail 30.

Pull-out rail 10 includes a pull-out rail lower ledge 14 extending laterally from downwardly depending pull-out rail upper ledge flange 15, as shown in FIGS. 1 and 3. The pull-out rail lower ledge 14 extends toward the pull-out rail roller 21 and is located in substantial vertical alignment with guide rail upper ledge flange 35 and lower ledge flange 36. During movement of pull-out rail 10 along guide rail 30, pull-out rail lower ledge 14, which rides underneath guide rail upper ledge flange 35, and above guide rail lower ledge flange 36, prevents a carried structure such as drawer 50 from contacting cabinet 52, if, for example, cabinet 52 is accidentally moved from its normally upright position.

In an embodiment of the present invention, a drawer guide assembly comprises means for limiting rearward movement of a pull-out rail relative to a guide rail. For example, a rearward motion stop member 41 is disposed on guide rail 30 for limiting rearward movement of pull-out rail 10 relative to guide rail 30. Rearward motion stop member 41 comprises a substantially V-shaped, downwardly depending projection formed in guide rail upper ledge 33 for engaging pull-out rail roller 21. Rearward motion stop member 41 is preferably positioned to prevent further inward movement of pull-out rail 10 at a predetermined point, most preferably at the most rearward point on guide rail 30. Positioning rearward motion stop member 41 at the most rearward point on guide rail 30 allows rear end 55 of drawer 50 to stop as close to rear wall 56 of furniture housing 52 as possible, thereby permitting the deepest drawer construction possible.

An embodiment of the present invention further comprises means for limiting forward movement of a pull-out rail relative to a guide rail. For example, a forward motion stop member 22 is disposed on pull-out rail 10 for limiting forward movement of pull-out rail 10 relative to guide rail 30. Forward motion stop member 22 comprises a substantially V-shaped, downwardly depending projection formed in pull-out rail upper ledge 13 for engaging guide rail roller 37. Pull-out rail forward motion stop member 22 is preferably configured to prevent further outward, or forward, movement of pull-out rail 10 at a predetermined point, most preferably the point at which the carried structure (such as drawer 50) is extended from cabinet 52 as far as it will extend. In a preferred embodiment, forward motion stop member 22 comprises two downwardly depending projections formed in pull-out rail upper ledge 13. The two downwardly depending projections are spaced apart to provide locking engagement of the guide rail roller between the two projections. The forward motion stop member with two projections thus provides a means for securing a drawer in position so that the drawer can be used to support a non-moving surface, for example, a cutting board.

"In an embodiment of the present invention, pull-out rail upper ledge 13 comprises an undermount attachment flange 17 extending laterally from pull-out rail 10 and having holes 60 suitable for fasteners for attaching pull-out rail 10 underneath a structure such as drawer 50. By fastening undermount attachment flange 17 to the bottom of a side wall 51 of drawer 50, pull-out rail 10 can be mounted in position for proper operation with guide rail 30. Pull-out rail lower ledge 14 further comprises a pull-out rail lower ledge extension 16 disposed at front end 11 of pull-out rail 10 that may be used for mounting pull-out rail 10 to the front wall of a drawer. Pull-out rail lower ledge extension 16 provides both additional strength for pull-out rail 10 by preventing bowing of the rail, and a means for easy alignment of pull-out rail 10 on drawer 50 or carried object during assembly. Pull-out rail 10 is further fastened to drawer 50 by attaching a pull-out rail rear end mounting bracket 53 to pull-out rail upper ledge 13 and to the rear end wall of drawer 50."

In an embodiment, as shown in FIG. 1, the pull-out rail rear end mounting bracket 53 is formed in an "L" shape having a horizontal shank and a vertical shank. The pull-out rail rear end mounting bracket 53 is attached to the superior aspect of the pull-out rail upper ledge 13. Pull-out rail rear end mounting bracket 53 is permanently fixed to pull-out rail upper ledge 13 via pressings between the two structures resulting in joining projections. Joining projections result when material derived from the pull-out rail upper ledge 13 and the horizontal shank of the rear end mounting bracket 53 are pressed together to form a connection securing the two together. An example of this type of connection is that produced by the process of TOX® Pressotechnik GmbH, of Weingarten, Germany. Use of this process for manufacture of a drawer slide represents an example of one aspect of the present invention.

Figure 5:
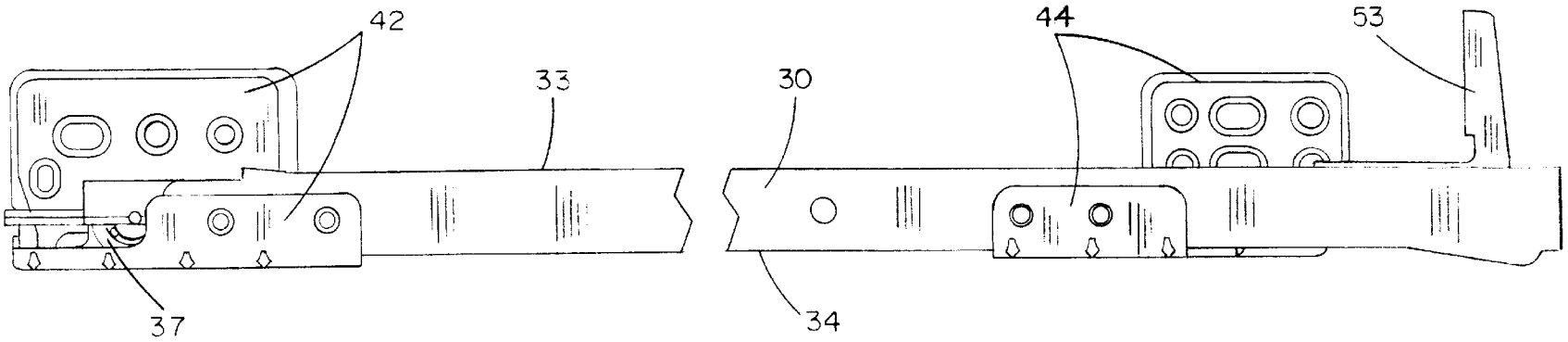
FIG. 5 is a side elevational view of a guide rail, showing a guide rail front end mounting bracket and a pull-out rail rear end mounting bracket, as well as an alternative guide rail intermediate mounting bracket in an embodiment of the present invention.

In an embodiment of the present invention, a guide rail is mounted to the inside wall of an article of furniture or cabinet by use of mounting means for at least guide rail front end 31 and for guide rail rear end 32. A guide rail front end mounting bracket 42 is preferably located on the outer side of the guide rail roller towards the side wall of a cabinet. A guide rail rear end mounting bracket 43 is preferably located at the end point of guide rail 30. In embodiments, means for mounting guide rail 30 to a furniture article includes an intermediate guide rail mounting bracket 44, as seen in FIG. 5, and one of guide rail front end mounting bracket 42 and guide rail rear end mounting bracket 42. Guide rail rear end mounting bracket 43 is configured so as to permit mounting of guide rail 30 to rear wall 56 of cabinet 52 and to allow lateral adjustment of guide rail 30 subsequent to mounting. Guide rail rear end mounting bracket 43 comprises a V-notch (not shown) configured within a channel formed within the bracket 43 for adjustably receiving guide rail rear end 32. In other embodiments, guide rail rear end mounting bracket 43 is configured without a V-notch.

In an another embodiment, a guide rail 30 is mounted to the cabinet housing, for example, in a frameless cabinet, with a guide rail intermediate mounting bracket 44, as seen in FIG. 5, and a front end mounting bracket 42. In other embodiments, guide rail 30 is mounted to a furniture cabinet using guide rail front end, rear end, or intermediate mounting brackets 42, 43, and 44, respectively, in various combinations. Most advantageously, an intermediate mounting bracket 44 is used in place of rear end mounting bracket 43.

Any number of materials may be used to form the drawer guide assemblies described herein. Rigid and semi-rigid plastic or metal materials have been used successfully, although other materials having similar physical properties may be utilized.

With respect to the descriptions set forth above, optimum dimensional relationship for the parts of the invention (to include variations in size, materials, shape, form, function, and manner of operation, assembly, and use) will be apparent to those skilled in the art, and all equivalent dimensional relationships to those illustrated in the drawings and described in the specification are intended to be encompassed herein.

The foregoing is considered as illustrative only of the principles of the invention. Since numerous modifications and changes will readily occur to those skilled in the art, the foregoing is not intended to limit the invention to the exact construction and operation shown and described. All suitable modifications and equivalents falling within the scope of the appended claims are considered within the present inventive concept.

The features of the present invention, together with other objects and advantages of the invention, and along with various features of novelty which characterize the present invention, are pointed out with particularity in the claims annexed to and forming a part of this disclosure.

What is claimed is:

1. A drawer guide assembly for carrying a movable structure in and out of an article of furniture, comprising:

a guide rail having front and rear ends and upper and lower ledges, the guide rail adapted to be mounted to the article of furniture in a horizontally disposed position; and a pull-out rail having front and rear ends and a longitudinal axis therebetween and adapted to be mounted underneath the movable structure so that the pull-out rail is concealed from view;

wherein the guide rail further comprises a guide rail roller disposed proximate the guide rail front end and rotatably mounted to the guide rail;

wherein the pull-out rail further comprises a pull-out rail upper ledge in rolling contact with the guide rail roller enabling movement of the pull-out rail and the moveable structure between forward and rearward positions relative to the guide rail, and a pull-out rail roller coupled to the pull-out rail and in rolling contact with the guide rail lower ledge; and wherein the pull-out rail upper ledge comprises a bend positioned proximate the front end of the pull-out rail and having a pull-out rail retaining member extending obliquely from the bend relative to the longitudinal axis of the pull-out rail in an upwardly inclined direction toward the pull-out rail front end, the pull-out rail retaining member having a run-in slope for engaging the guide rail roller in a rearward position of the pull-out rail relative to the guide rail.

2. The drawer guide assembly of claim 1, wherein the guide rail roller and the pull-out rail roller are substantially aligned in a horizontal plane.

3. The drawer guide assembly of claim 1, wherein the pull-out rail roller is in rolling contact with the guide rail upper ledge.

4. The drawer guide assembly of claim 1, wherein the pull-out rail upper ledge further comprises a pull-out rail upper ledge flange in rolling contact with the guide rail roller.

5. The drawer guide assembly of claim 4, wherein the pull-out rail upper ledge further comprises a downward projection located along the longitudinal axis of the pull-out rail and spaced from the pull-out rail upper ledge flange to provide a channel for continuous rolling engagement of the guide rail roller.

6. The drawer guide assembly of claim 1, wherein the guide rail upper ledge further comprises a downwardly protruding guide rail upper ledge flange for continuous rolling engagement of the pull-out rail roller.

7. The drawer guide assembly of claim 6, wherein the guide rail lower ledge further comprises an upwardly protruding guide rail lower ledge flange for continuous rolling engagement of the pull-out rail roller.

8. The drawer guide assembly of claim 7, wherein the pull-out rail further comprises a pull-out rail lower ledge extending toward the pull-out rail roller and in substantial vertical alignment with the guide rail upper ledge flange and lower ledge flange.

9. The drawer guide assembly of claim 8, wherein the pull-out rail lower ledge further comprises a pull-out rail lower ledge extension disposed at the front end of the pull-out rail.

10. The drawer guide assembly of claim 9, wherein the pull-out rail lower ledge extension comprises an upper edge adapted to contact a bottom face of a member of the moveable structure when the pull-out rail is installed.

11. The drawer guide assembly of claim 1, wherein the guide rail lower ledge comprises a bend positioned proximate the rear end of the guide rail and having a guide rail retaining member extending obliquely from the bend relative to the guide rail in an downwardly inclined direction toward the guide rail rear end, and the guide rail retaining member having a run-in slope substantially parallel to the run-in slope of the pull-out rail retaining member for engaging the pull-out rail roller.

12. The drawer guide assembly of claim 11, wherein the pull-out rail roller is disposed proximate the rear end of the pull-out rail so that when the pull-out rail is in a rearward position relative to the guide rail, the guide rail retaining member engages the pull-out rail roller.

13. The drawer guide assembly of claim 1, further comprising means for limiting rearward movement of the pull-out rail relative to the guide rail.

14. The drawer guide assembly of claim 13, wherein the limiting means further comprises a rearward motion stop member disposed on the guide rail for limiting rearward movement of the pull-out rail relative to the guide rail.

15. The drawer guide assembly of claim 14, wherein the rearward motion stop member further comprises a downwardly depending projection formed in the guide rail upper ledge for engaging the pull-out rail roller.

16. The drawer guide assembly of claim 15, wherein the downwardly depending projection formed in the guide rail upper ledge is substantially V-shaped.

17. The drawer guide assembly of claim 1, further comprising means for limiting forward movement of the pull-out rail relative to the guide rail.

18. The drawer guide assembly of claim 17, wherein the limiting means comprises a forward motion stop member disposed on the pull-out rail for limiting forward movement of the pull-out rail relative to the guide rail.

19. The drawer guide assembly of claim 18, wherein the forward motion stop member further comprises at least one downwardly depending projection formed in the pull-out rail upper ledge for engaging the guide rail roller.

20. The drawer guide assembly of claim 19, wherein the at least one downwardly depending projection formed in the pull-out rail upper ledge is substantially V-shaped.

21. The drawer guide assembly of claim 19, wherein the forward motion stop member comprises two downwardly depending projections formed in the pull-out rail upper ledge, the two downwardly depending projections spaced apart to provide locking engagement of the guide rail roller therebetween.

22. The drawer guide assembly of claim 1, wherein the pull-out rail upper ledge further comprises an undermount attachment flange extending laterally from the pull-out rail and having holes suitable for fasteners for attaching the pull-out rail underneath the moveable structure.

23. The drawer guide assembly of claim 1, wherein the pull-out rail further comprises a pull-out rail rear end mounting bracket attached to the pull-out rail upper ledge near the pull-out rail rear end.

24. The drawer guide assembly of claim 23, wherein the pull-out rail rear end mounting bracket is permanently fixed to the pull-out rail upper ledge.

25. The drawer guide assembly of claim 1, wherein the guide rail further comprises a means for mounting the guide rail to the furniture article.

26. The drawer guide assembly of claim 25, wherein the means for mounting the guide rail to the furniture article comprises at least a guide rail front end mounting bracket and a guide rail rear end mounting bracket.

27. The drawer guide assembly of claim 26, wherein the means for mounting the guide rail to the furniture article comprises an intermediate guide rail mounting bracket and one of the guide rail front end mounting bracket and the guide rail rear end mounting bracket.

28. The drawer guide assembly of claim 26, wherein the guide rail rear end mounting bracket is adapted to be mounted to the rear wall of the furniture article and to adjustably receive the guide rail rear end, and wherein the guide rail may be adjusted laterally after the guide rail is attached to the rear end mounting bracket.

29. The drawer guide assembly of claim 28, wherein the guide rail rear end mounting bracket comprises a channel for adjustably receiving the guide rail rear end.

30. The drawer guide assembly of claim 29, wherein the guide rail rear end mounting bracket channel further comprises a V-shaped notch for adjustably receiving the guide rail rear end.

31. A drawer guide assembly for carrying a movable structure in and out of an article of furniture, comprising:

a guide rail having front and rear ends and upper and lower ledges, the guide rail adapted to be mounted to the article of furniture in a horizontally disposed position; and a pull-out rail having front and rear ends and a longitudinal axis therebetween and adapted to be mounted underneath the movable structure so that the pull-out rail is concealed from view;

wherein the guide rail further comprises a guide rail roller disposed proximate the guide rail front end and rotatably mounted to the guide rail;

wherein the pull-out rail further comprises a pull-out rail upper ledge in rolling contact with the guide rail roller enabling movement of the pull-out rail and the moveable structure between forward and rearward positions relative to the guide rail, and a pull-out rail roller coupled to the pull-out rail and in rolling contact with the guide rail lower ledge;

wherein the guide rail roller and the pull-out rail roller are substantially aligned in a horizontal plane;

wherein the pull-out rail upper ledge further comprises a pull-out rail upper ledge flange in rolling contact with the guide rail roller;

wherein the pull-out rail upper ledge further comprises a downward projection located along the longitudinal axis of the pull-out rail and spaced from the pull-out rail upper ledge flange to provide a channel for continuous rolling engagement of the guide rail roller;

wherein the guide rail upper ledge further comprises a downwardly protruding guide rail upper ledge flange for continuous rolling engagement of the pull-out rail roller;

wherein the guide rail lower ledge further comprises an upwardly protruding guide rail lower ledge flange for continuous rolling engagement of the pull-out rail roller;

wherein the pull-out rail further comprises a pull-out rail lower ledge extending toward the pull-out rail roller and in substantial vertical alignment with the guide rail upper ledge flange and lower ledge flange; and wherein the pull-out rail upper ledge comprises a bend positioned proximate the front end of the pull-out rail and having a pull-out rail retaining member extending obliquely from the bend relative to the longitudinal axis of the pull-out rail in an upwardly inclined direction toward the pull-out rail front end, the pull-out rail retaining member having a run-in slope for engaging the guide rail roller in a rearward position of the pull-out rail relative to the guide rail.

32. The drawer guide assembly of claim 31, wherein the pull-out rail upper ledge further comprises a bend positioned proximate the front end of the pull-out rail and having a pull-out rail retaining member extending obliquely from the bend relative to the longitudinal axis of the pull-out rail in an upwardly inclined direction toward the pull-out rail front end, the pull-out rail retaining member having a run-in slope for engaging the guide rail roller in a rearward position of the pull-out rail relative to the guide rail;

wherein the guide rail lower ledge further comprises a bend positioned proximate the rear end of the guide rail and having a guide rail retaining member extending obliquely from the bend relative to the guide rail in an downwardly inclined direction toward the guide rail rear end, and the guide rail retaining member having a run-in slope substantially parallel to the run-in slope of the pull-out rail retaining member for engaging the pull-out rail roller;

wherein the guide rail further comprises a rearward motion stop member comprising a substantially V-shaped, downwardly depending projection formed in the guide rail upper ledge for engaging the pull-out rail roller so as to limit rearward movement of the pull-out rail relative to the guide rail; and wherein the pull-out rail further comprises a forward motion stop member comprising a substantially V-shaped, downwardly depending projection formed in the pull-out rail upper ledge for engaging the guide rail roller so as to limit forward movement of the pull-out rail relative to the guide rail.

* * * * *